US006925934B2

(12) United States Patent
Weschenfelder et al.

(10) Patent No.: US 6,925,934 B2
(45) Date of Patent: Aug. 9, 2005

(54) CYLINDER OF A PRINTING MACHINE

(75) Inventors: Kurt Johannes Weschenfelder, Zell/Main (DE); Hans Dierk Mohrmann, Greussenheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 132 days.

(21) Appl. No.: 10/475,093

(22) PCT Filed: Feb. 20, 2002

(86) PCT No.: PCT/DE02/00605

§ 371 (c)(1),
(2), (4) Date: Oct. 27, 2003

(87) PCT Pub. No.: WO02/087884

PCT Pub. Date: Nov. 7, 2002

(65) Prior Publication Data

US 2004/0144275 A1 Jul. 29, 2004

(30) Foreign Application Priority Data

Apr. 27, 2001 (DE) ..... 101 20 958

(51) Int. Cl.[7] ..... B41F 31/00
(52) U.S. Cl. ..... 101/351.6; 101/389.1
(58) Field of Search ..... 101/351.6, 349.1, 101/348, 375, 389.1, 368, 206, 205, 216, 212, 174, 329

(56) References Cited

U.S. PATENT DOCUMENTS

| | | | | | |
|---|---|---|---|---|---|
| 795,858 | A | | 8/1905 | Rafter | 101/204 |
| 1,915,837 | A | | 6/1933 | Porter | 101/204 |
| 3,885,498 | A | * | 5/1975 | Jenkins | 101/389.1 |
| 3,919,937 | A | * | 11/1975 | Kostal | 101/378 |
| 4,029,013 | A | * | 6/1977 | George et al. | 101/389.1 |
| 4,823,697 | A | * | 4/1989 | Randazzo | 101/375 |
| 5,230,271 | A | * | 7/1993 | Hardisty et al. | 83/698.21 |
| 5,845,574 | A | | 12/1998 | Dilling et al. | 101/351.6 |
| 5,904,096 | A | * | 5/1999 | Fawcett et al. | 101/389.1 |

FOREIGN PATENT DOCUMENTS

| | | |
|---|---|---|
| DE | 27 45 086 | 4/1979 |
| DE | 196 28 647 A1 | 1/1998 |
| FR | 358 301 | 2/1906 |

* cited by examiner

*Primary Examiner*—Anthony H. Nguyen
(74) *Attorney, Agent, or Firm*—Jones Tullar & Cooper PC

(57) ABSTRACT

A cylinder of a rotary printing machine has a peripheral surface which is divided into at least two segments that are situated adjacent to each other, in an axial direction of the cylinder, by a circumferential groove. Those circumferential grooves can be closed by the placement in the groove of a suitable inlay or insert element. That inlay or insert element is formed of several parts, typically of two inlay or insert parts, whose peripheral surfaces complement each other to form a continuous cylindrical peripheral surface on the cylinder after the inlay or insert parts have been placed in the grooves.

11 Claims, 3 Drawing Sheets

CYLINDER OF A PRINTING MACHINE

FIELD OF THE INVENTION

The present invention is directed to a roller of a printing press. A circumferential face of the roller is divided into at least two cylinder-shaped sections which are located next to each other and which are separated from each other by a groove.

BACKGROUND OF THE INVENTION

Rollers which are intended for use in printing presses can be employed, for example, as ink transport rollers, typically as inking rollers, ink ductors, application rollers or distributing rollers in inking systems, which ink transport rollers can be changed from use in panoramic printing to use in printing in several colors next to each other. Panoramic printing is understood to be the printing of an image over two pages without a break. With a printing press of a width of four pages, it is therefore possible, during panoramic printing, to print two panoramic images, each extending over two pages. When changing a printing group from panoramic printing to printing in several colors next to each other, or vice versa, various retooling procedures are required at the inking system, depending on its type.

In order to reduce the retooling work that is typically required, ink transport rollers are known from DE 196 28 647 A1, in which recesses that are located between the individual cylinder-shaped sections of the inking roller can be selectively closed off. In accordance with an embodiment described in DE 196 28 647 A1, a strip-shaped insertion element is used and which is clamped on the roller and thus closes off the recess. In this prior device, the strip-shaped insert element can be made of plastic with a sufficiently high heat expansion coefficient, so that the strip, after having been heated in a water bath, can be mounted on the roller and thereafter is clamped and closes the recess while the strip is subjected to cooling. Alternatively, it is also possible to employ steel strips with copper surfaces, which steel strips can also be clamped on the roller in the normal state by applying mechanical clamping forces.

U.S. Pat. No. 795,858 shows an inking roller whose barrel has two sections that are separated by a groove. This groove can be closed off by the use of two half shells.

SUMMARY OF THE INVENTION

The object of the present invention is directed to providing a roller for a printing press.

In accordance with the present invention, this object is attained by the provision of a roller of a printing press whose circumferential surface has at least two cylinder-shaped sections which are located adjacent each other and which are separated from each other by a circumferential groove. In order to provide a continuous roller jacket surface, the groove can be closed by the provision of at least one removable groove insert. That removable groove insert can be maintained in the groove by magnetic force. A handle can be removably secured to the insert, also by magnetic force.

An advantage to be gained by the present invention lies, in particular, in that, because of the multiple embodiment of the insertion element, it is possible to produce an insertion element which can be greatly mechanically stressed and which can also be produced geometrically very exactly. When using the strip-shaped insertion elements known in the prior art, it was required, for mounting the insertion elements on the roller, to deform the insertion elements, at least slightly. Accordingly, the previously known and available insertion elements could only have a defined maximum stability. Because of the embodiment of the insertion element in a divided manner in the form of several insertion parts which complement each other and which cooperate in the forming of a cylinder-shaped circumferential surface, it is possible to avoid the deformation of the individual insertion parts in the course of mounting, or dismounting the insertion parts.

BRIEF DESCRIPTION OF THE DRAWINGS

A preferred embodiment of the present invention is represented by way of example in the drawings and will be described in greater detail in what follows.

Shown are in.

DESCRIPTION OF THE PREFERRED EMBODIMENT

Figure 1:
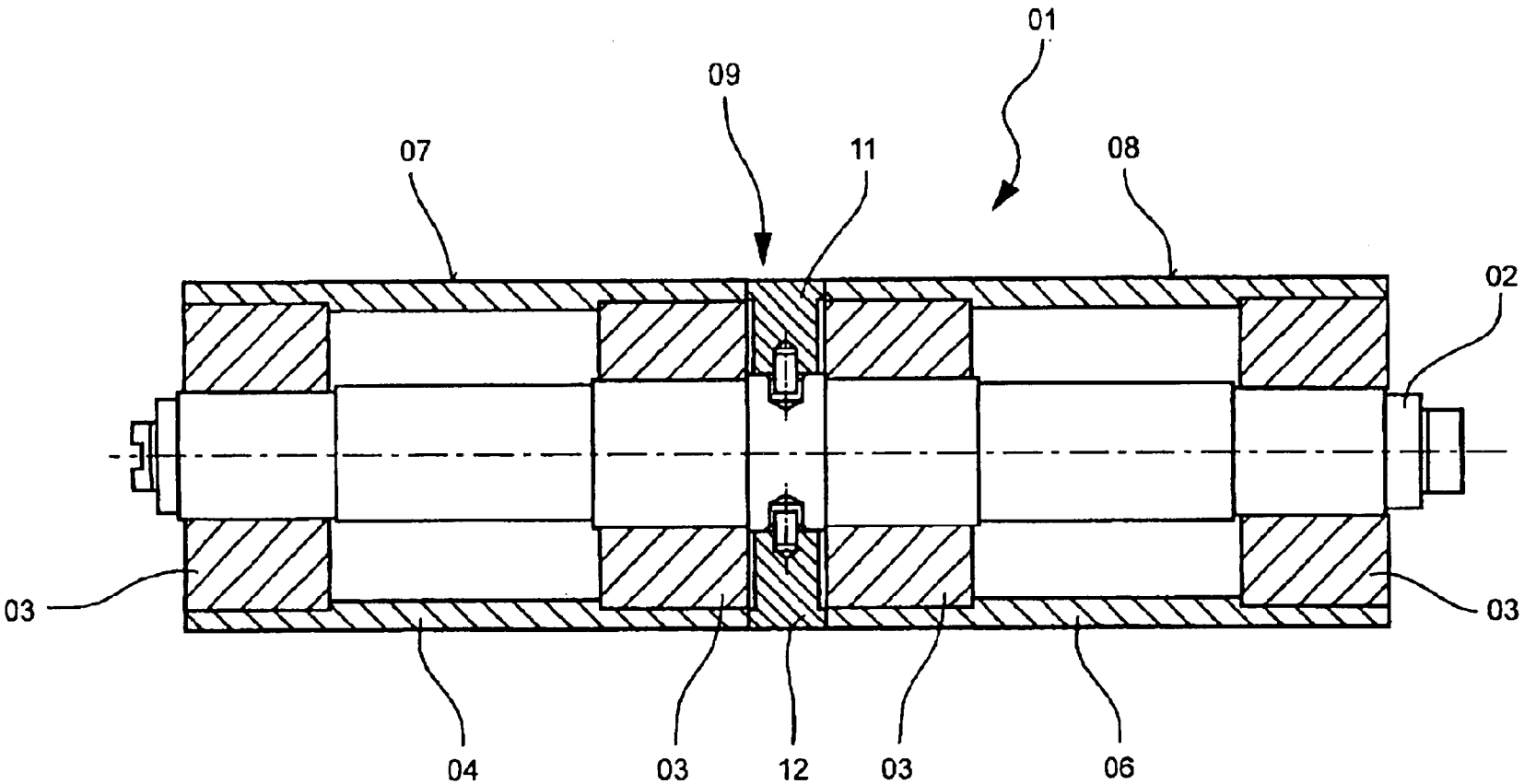
FIG. 1, a cross-sectional view through a roller of a printing press in accordance with the present invention, in FIG. 2, an enlarged portion of the cross-sectional view shown in FIG. 1, and in FIG. 3, a section through the roller shown in FIG. 2 and taken along the line I—I of FIG. 2.

A roller 01 for a printing press, in accordance with the present invention, is represented in FIG. 1, which roller 01 can find use typically as an ink ductor roller which is arranged in an ink duct of a rotary printing press. A continuous shaft 02 is provided for use in rotatably supporting the roller 01 in a frame of a printing press, which is not specifically represented. Two tube-shaped cylinder elements 04, 06 are seated on the roller shaft 02 by four hubs 03, which two cylinder elements 04, 06 are seated next to each other. Jacket surfaces of the two cylinder elements 04, 06 form two cylinder-shaped sections 07, 08, respectively which two cylinder-shaped sections 07, 08 are separated from each other by a centrally arranged groove 09, for example a recess 09, so that different colored inks carried by the two cylinder-shaped sections 07, 08 are not inadvertently intermixed.

In the representation of FIG. 1, an insertion element, which is formed by two insertion elements 11, 12, for example two insertion parts 11, 12, is arranged in the recess 09 and completely closes the recess 09. The exterior diameter of the resultant insertion element, that is formed by the insertion parts 11, 12, has been selected in such a way that circumferential faces of the two insertion parts 11, 12 complement each other and cooperate to form a resultant cylinder-shaped circumferential face. The cylinder-shaped circumferential face of the insertion elements or parts 11, 12 makes a clean transition into and between the circumferential faces of the two spaced cylinder-shaped sections 07, 08, so that, as a result, a continuous jacket surface is formed on the roller 01 by the arrangement of the insertion parts 11, 12 in the recess 09. This continuous jacket surface can be used for ink transport of an ink during panoramic printing. If the roller 01 is to be retooled for multi-color printing, the insertion parts 11, 12 can be simply removed, so that two separate cylinder-shaped sections 07, 08, for the application of different colors, are again provided on roller 01.

Figure 2:
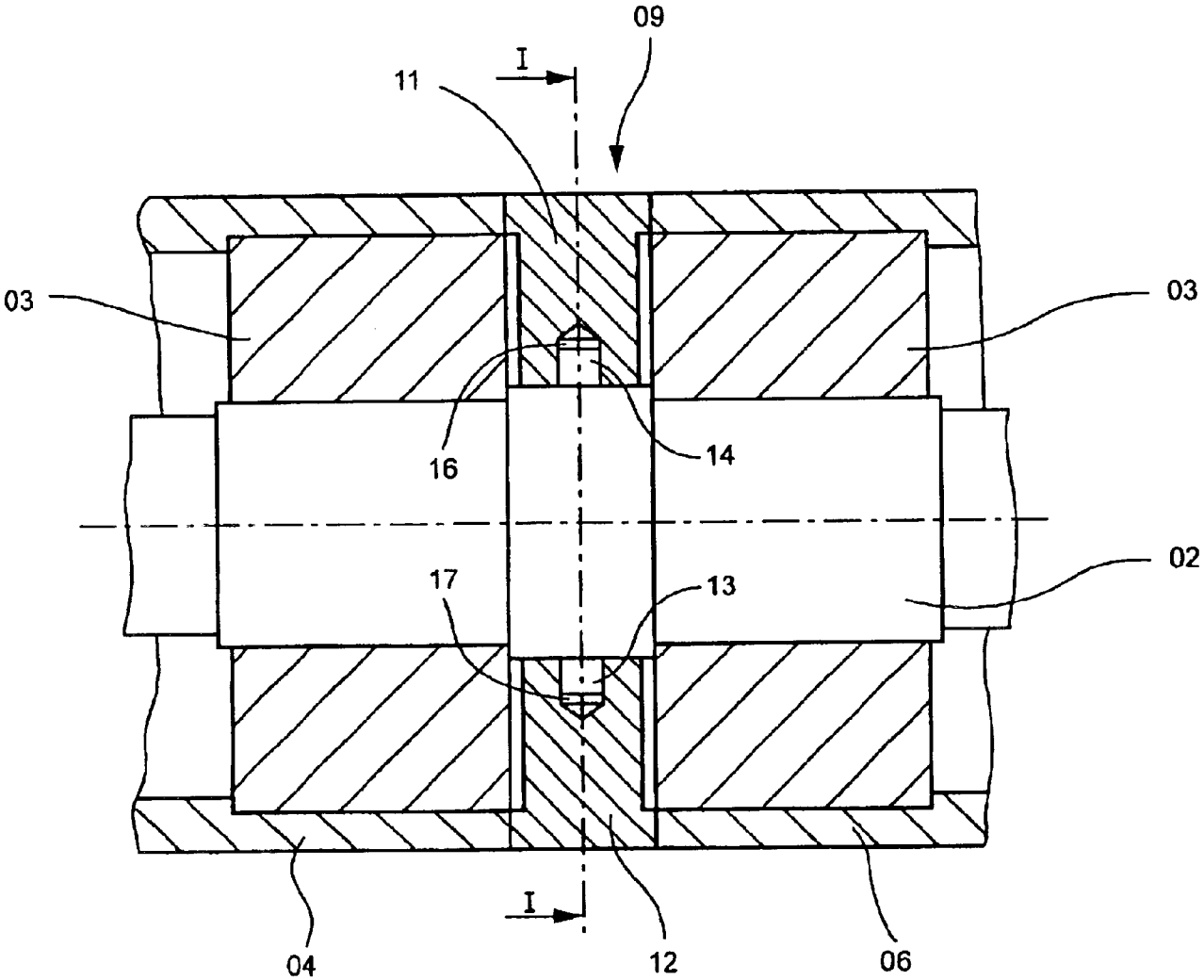

FIG. 2 shows the arrangement of the insertion parts 11, 12 in the recess 09 in an enlarged representation. In order to transmit a torque between the roller shaft 02 and insertion part 11, 12, bolt-shaped force transmitting elements 13, 14 are fastened on the circumference of the shaft 02, and which can be received cooperatively shaped recesses 16, 17 in the insertion parts 11, 12. The force transmitting elements 13, 14 have different diameters, so that the insertion parts 11, 12 can be mounted in only one installed position on the shaft 02. By use of this structure, it is assured that ground functional surfaces of the two insertion parts 11, 12 come to rest against each other in the correct position.

Figure 3:
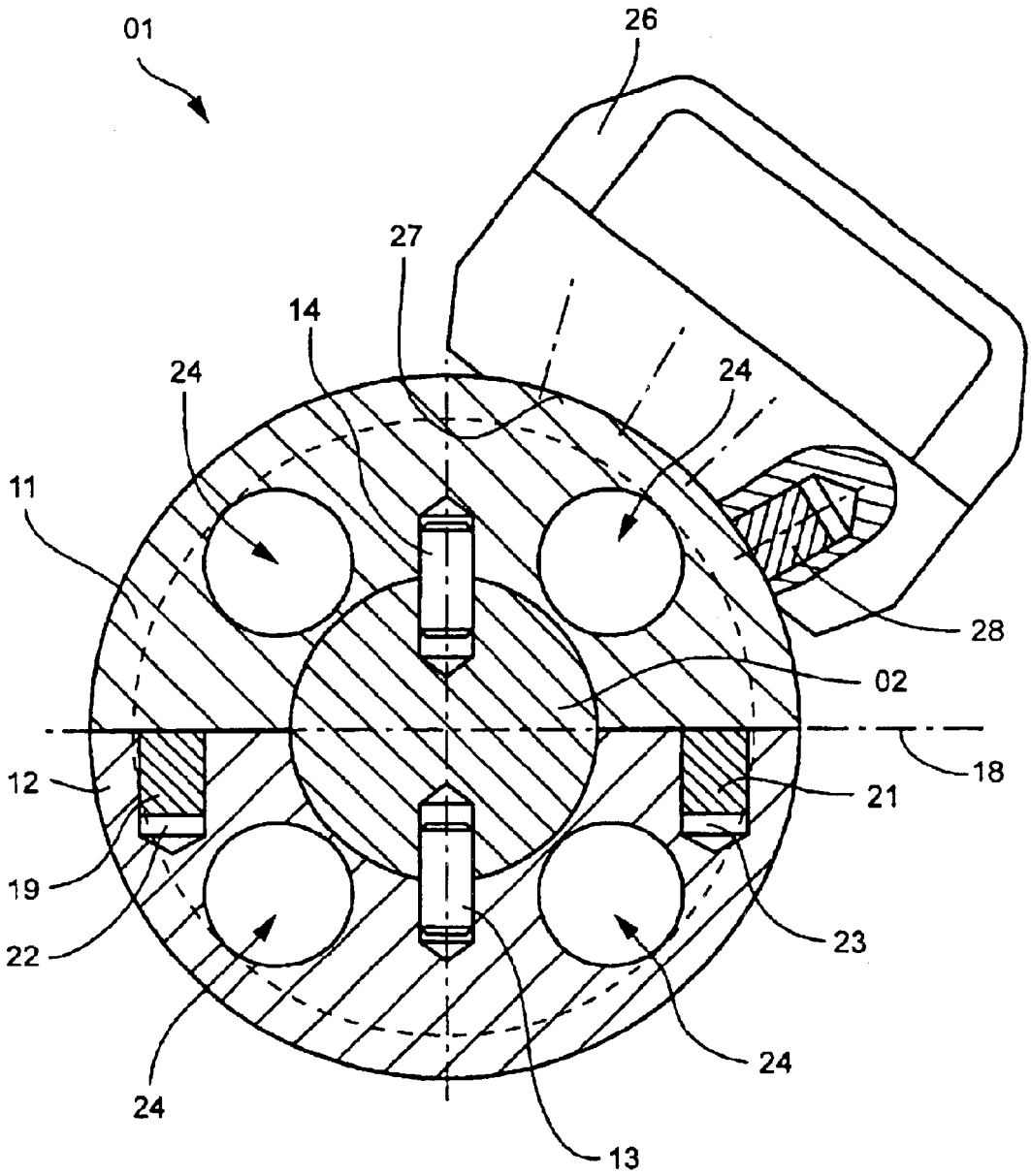

FIG. 3 shows the roller 01 in accordance with the present invention in a cross-section, taken along the section line I—I of FIG. 2. The two insertion parts 11, 12 can be seen, each of which is embodied in the manner of half a circular disk and which complement each other to form a circular disk whose interior diameter corresponds to exactly the exterior diameter of the corresponding shaft section of the shaft 02, and whose exterior diameter corresponds to exactly the exterior diameter of the cylindrical sections 07, 08. The insertion element, which is constituted of the two cooperating insertion parts 11, 12, can be separated along a level separating seam 18, so that the insertion parts 11, 12 can be mounted, or dismounted, by the use of a simple linear joining movement.

Two bolt-like magnetic elements 19, 21, which are fastened or secured in recesses 22, 23 respectively, that are provided in the insertion part 12 adjacent its flat, ground functional surface, are provided on the insertion part 12 for use in fixing the insertion parts 11, 12 in place on the shaft 02. The magnetic force of the magnetic elements 19 or 21 acts on the insertion parts 11, 12, across the separating seam 18, so that the insertion parts 11, 12 are non-positively held together about the shaft 02.

To reduce the centrifugal forces which are acting on the insertion parts 11, 12 during the rotation of the roller 01, continuous recesses or weight reducing cutouts 24 have been cut into the insertion parts 11, 12 and extend parallel with the jacket surface of the roller 01, as seen in FIG. 3.

Since the insertion parts 11, 12 are kept together by the interiorly located magnetic elements 19, 21, a circumferential face, which is substantially free of grooves, can be realized on the circumference of the insertion parts 11, 12. This circumferential face is interrupted only by the separating seam 18. That circumferential interruption can be reduced to a tolerable amount by an appropriate grinding of the contact surfaces of the insertion parts 11, 12 which are facing and abutting each other. For dismounting the insertion parts 11, 12, from the shaft 02 of roller 01, no conventional tool can be employed because of the lack of engagement faces on the circumference of the insertion parts 11, 12. Therefore a handle 26 is used for dismounting the insertion parts 11, 12, which handle 26 can be provided with a concave functional surface 27 that can be placed in positive contact on the cylinder-shaped circumferential face of the insertion parts 11, 12. So that the insertion part 11 can be pulled radially outwardly while overcoming the magnetic forces exerted by the magnetic elements 19, 21, as depicted in FIG. 3, a magnetic element 28 is provided on the handle 26. A pull-off force can be non-positively transmitted from the handle 26 to the insertion part 11 by the use of the magnetic field of the magnetic element 28, which is designed in the manner of a permanent magnet. The oppositely located insertion part 12 only needs to be pulled off radially outward after the insertion part 11 has been pulled off.

While a preferred embodiment of a cylinder or a roller for a printing machine, in accordance with the present invention, has been set forth fully and completely hereinabove, it will be apparent to one of skill in the art that changes could be made in, for example the overall size of the roller, the type of surface on the cylinder-shaped sections and the like without departing from the true spirit and scope of the present invention which is accordingly to be limited only by the following claims.

What is claimed is:

1. A roller addapted for use in a printing press comprising:

at least first and second cylinder-shaped sections located adjacent each other;

a roller circumferential face formed by said at least first and second cylinder-shaped sections;

a groove between said at least first and second cylinder-shaped sections;

at least one insertion part removably positionable in said groove and adapted to cooperate with said roller circumferential face to form a continuous jacket surface; and magnetic means usable to hold said at least one insertion part in said groove.

2. The roller of claim 1 wherein said insertion part is configured as two semi-circular disks.

3. The roller of claim 1 wherein said at least one insertion part is metal.

4. The roller of claim 3 wherein said metal is steel.

5. The roller of claim 1 wherein said magnetic means includes at least one magnetic element arranged on at least one of said at least one insertion part and said roller.

6. The roller of claim 5 further including at least one recess in said at least one insertion part and wherein said at least one magnetic element is fastened in said at least one recess.

7. The roller of claim 1 further including at least one cutout in said at least one insertion part, said at least one cutout extending parallel with said jacket surface.

8. The roller of claim 1 further including at least one force transmitting element on one of said roller and said insertion part and a cooperatively located force transmitting element receiving recess on the other of said roller and said insertion part.

9. The roller of claim 8 further including first and second insertion parts and first and second force transmitting elements, said first and second force transmitting elements having first and second dimensions, said first and second dimensions being different.

10. The roller of claim 1 wherein said roller is an inking roller.

11. The roller of claim 10 wherein said inking roller is an ink ductor roller.

* * * * *